US005549338A

United States Patent [19]

Wingfield et al.

[11] Patent Number: 5,549,338

[45] Date of Patent: Aug. 27, 1996

[54] KEYLESS LOCK

[75] Inventors: Andy Q. Wingfield; James L. Thomas, both of Irving, Tex.

[73] Assignee: Access Protection Manufacturing, LLC, Plaistow, N.H.

[21] Appl. No.: 565,418

[22] Filed: Nov. 30, 1995

Related U.S. Application Data

[63] Continuation of Ser. No. 191,880, Feb. 4, 1994, abandoned.

[51] Int. Cl.[6] ..... E05C 19/18

[52] U.S. Cl. ..... 292/292; 292/295

[58] Field of Search ..... 292/288–290, 292/292, 295, 298, 302, 340; 70/14

[56] References Cited

U.S. PATENT DOCUMENTS

| | | | |
|---|---|---|---|
| 10,511 | 2/1854 | Webb | 292/292 |
| 692,083 | 1/1902 | Spear | 292/292 |
| 761,955 | 6/1904 | Glock | 292/292 |
| 866,548 | 1/1907 | Wilkinson | 292/292 |
| 1,050,360 | 1/1913 | Hall | 292/292 |
| 1,869,689 | 8/1932 | Holland | 292/288 |
| 3,451,235 | 6/1969 | Weingart | 292/292 |
| 4,471,981 | 9/1984 | Wright | 292/292 |
| 5,193,867 | 3/1993 | Husted | 292/295 |

FOREIGN PATENT DOCUMENTS

| | | | |
|---|---|---|---|
| 502377 | 3/1939 | United Kingdom | 292/340 |
| 1153751 | 5/1969 | United Kingdom | 292/340 |

*Primary Examiner*—Steven N. Meyers
*Assistant Examiner*—Gary Estremsky
*Attorney, Agent, or Firm*—Timmons & Kelly

[57] ABSTRACT

A base plate with an extension which defines a pair of notched seats is secured to the frame of a pivoting door in the gap between the frame and the door. A stop plate, made from a disk of stiff metal plate having an aperture of predetermined shape and with three bent sections that form a hand grip, is initially placed over the extension on the base plate while the door is closed. The stop plate aperture allows the stop plate to be displaced horizontally and downwardly until the section of stop plate defining the opposite end of the aperture lies within the upper notched seat and rests on the base plate. The stop plate confronts the face plane of the door; the door is prevented from opening beyond the door frame by the combination of the stop plate and the base plate.

14 Claims, 4 Drawing Sheets

KEYLESS LOCK

This application is a continuation of utility application Ser. No. 08/191,880 filed Feb. 4, 1994, now abandoned.

BACKGROUND OF THE INVENTION

1. Field of the Invention

This invention relates in general to door locks. In particular, the invention relates to keyless door locks that can be operated only from the secured side of the door.

2. Description of the Related Art

Dead bolt locks have been used on entrances to homes, hotels and apartments for many years. Typically, these locks use a key and tumbler system that allows them to be locked and unlocked from outside. This leaves the effectiveness of the lock dependent on the integrity of personnel having pass keys to the entire complex. For their own peace of mind, many apartment dwellers and guests at hotels would prefer a lock that can only be unlocked from inside the room.

Several types of keyless locks are sold, but they have drawbacks. A common type uses a cylindrical bolt with a groove ring that slides into a slot that is affixed to the door; the bolt is secured to the door frame with a chain. This type of lock is often difficult to secure and unlock, and some versions can be defeated by forcing the door open. Also, most versions of this type of lock allow the door to be opened sufficiently to permit cutting the chain from outside the door.

SUMMARY OF THE INVENTION

The general object of the invention is to prevent opening of a door. This objective is achieved by a base plate that is secured to the door frame and a stop plate that has an aperture designed to enable the stop plate to interconnect with the base plate. When interconnected, the stop plate rests within a notched seat behind an extension in the base plate. With the door in the closed position and the stop plate installed, the stop plate confronts the door and the base plate extension, preventing the door from being opened.

Another objective of the invention is to permit engaging and disengaging the lock only from inside the door. This objective is obtained by the method of securing the lock. Because the stop plate must be manually interconnected with the base plate, the lock can be engaged only from the side of the door to be secured.

Yet another objective of the invention is to ensure positive seating of the stop plate with a minimum of operator manipulation. This objective is achieved by the shape of the aperture in the stop plate. The aperture is configured so that, once the stop plate is initially interconnected with the base plate, a simple lateral displacement will effectively seat the plate. The aperture can be configured so that the weight of the stop plate will assist this displacement.

Another objective of the invention is to allow proper operation even if the stop plate is not properly seated. This objective is also achieved by the shape of the stop plate aperture. The aperture is designed so that the initial position of the stop plate relative to the base plate is the only position presenting an opening wide enough to permit the base plate extension to be passed through the stop plate aperture. Once the stop plate is laterally displaced from this position, the base plate extension will always present an obstruction to the stop plate, preventing its removal.

The above, as well as additional objects, features, and advantages of the invention will become apparent in the following detailed description.

DESCRIPTION OF THE PREFERRED EMBODIMENT

Figure 1:
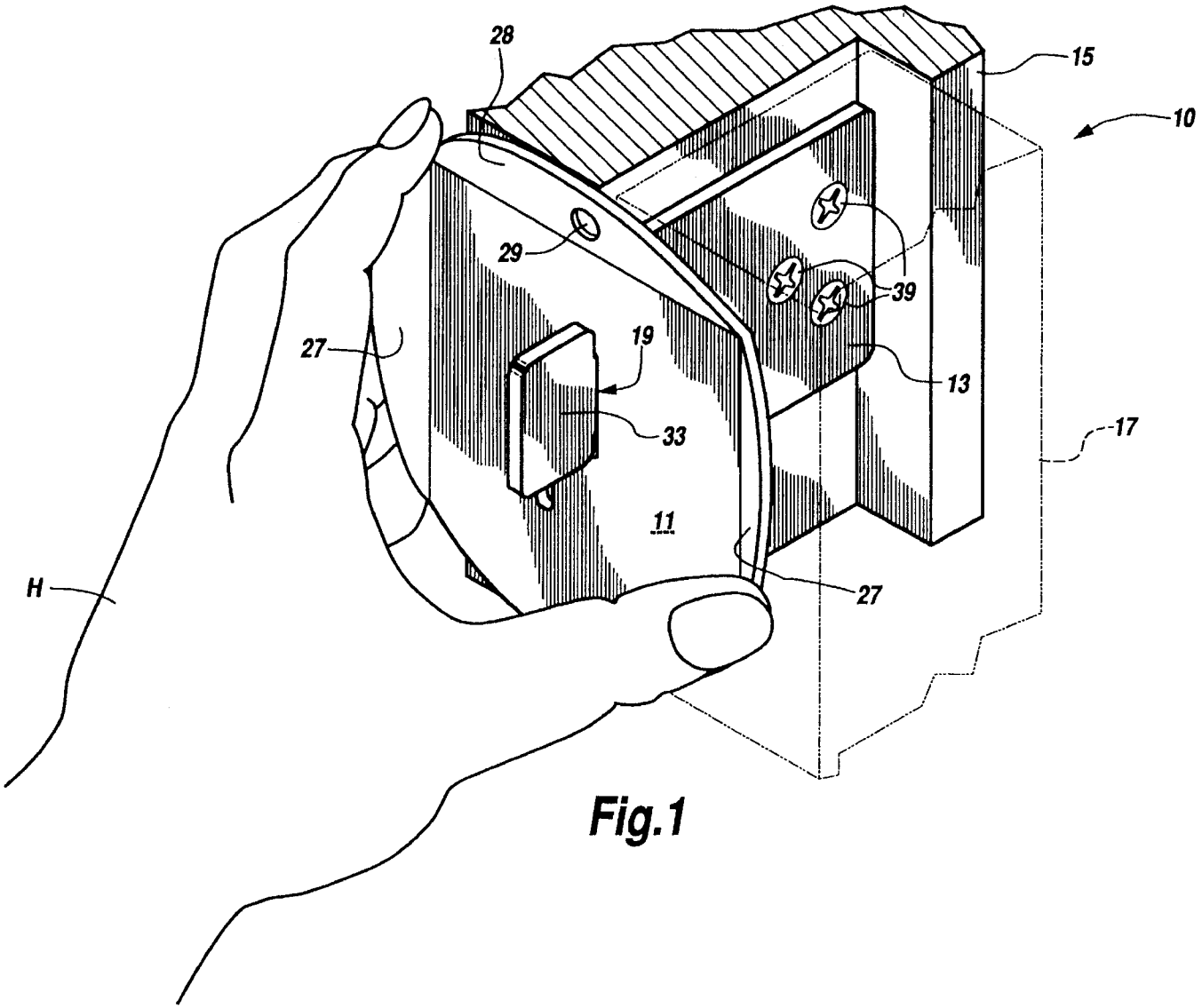
FIG. 1 is a perspective view of the preferred embodiment of a keyless lock of the invention as it appears when in use.

Referring now to the drawings, and in particular to FIG. 1, we see a preferred embodiment 10 of a keyless door lock of the invention being manually engaged on a door and frame. A stop plate 11 is interfit on a base plate 13 adapted to be installed on the frame 15 of a swinging door 17. Both the stop plate 11 and the base plate 13 are constructed from 12 gage (2.7 millimeters thick) sheet metal. It is preferred that all corners be rounded slightly.

Figure 2:
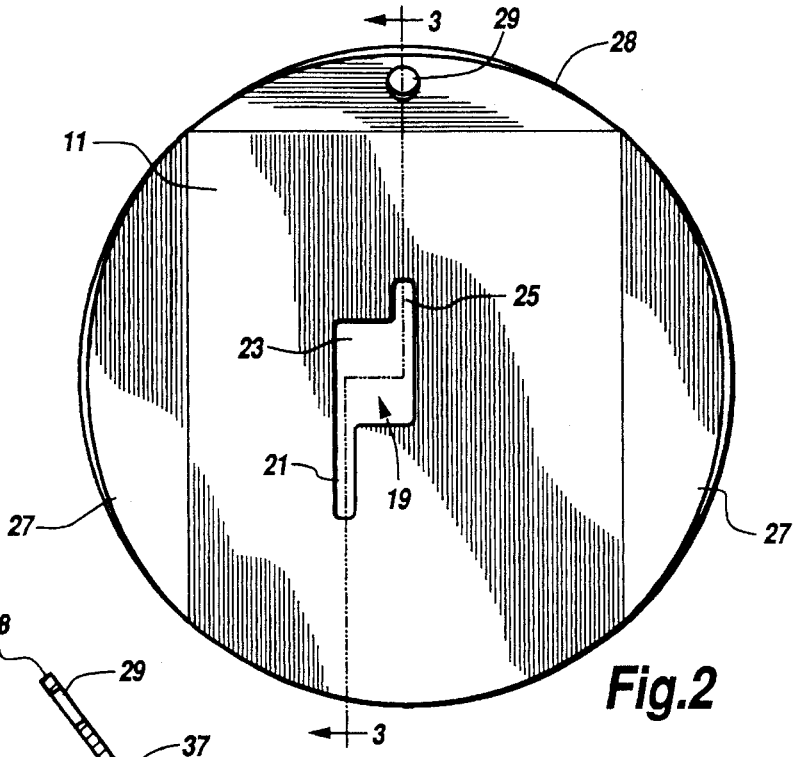
FIG. 2 is a front elevational view of the stop plate.
Figure 3:
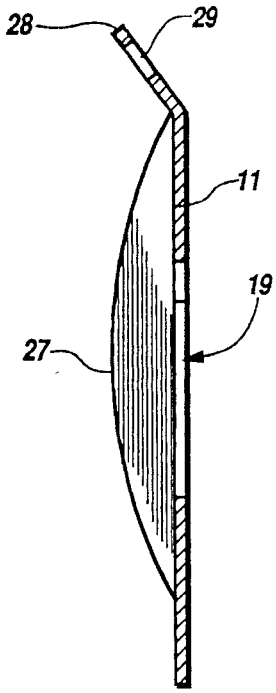
FIG. 3 is a side cross sectional view of the stop plate when viewed along line 3—3 in FIG. 2.
Figure 4:
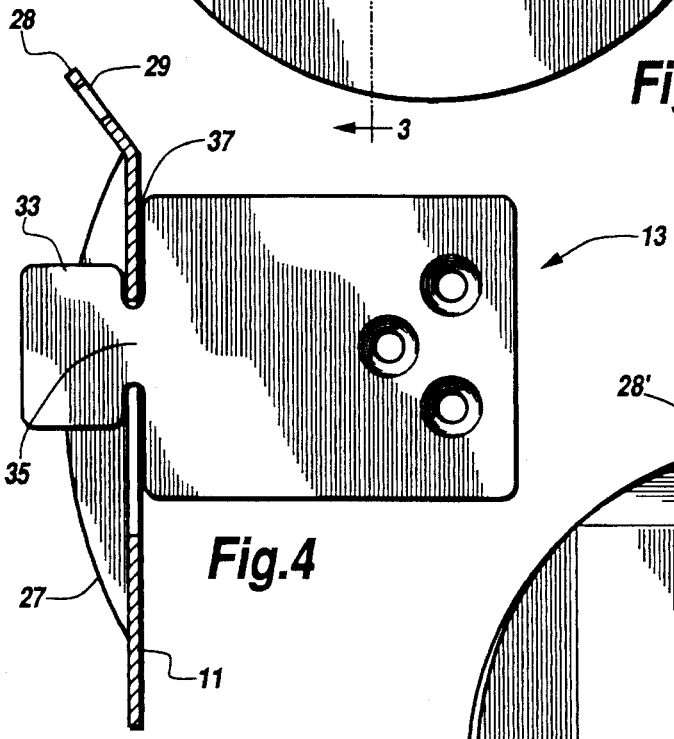
FIG. 4 is a right side elevational view of the base plate superimposed over the cross sectional view of FIG. 3, showing how the base plate interconnects with the stop plate.

As shown in FIGS. 2–4, the stop plate 11 is a disc with a diameter of four inches (102 millimeters). An aperture 19 is cut into the stop plate 11 having a shape comprising a long slot 21 connected by a gap 23 to a short slot 25 that is parallel to the long slot 21 and offset diagonally from it. The slots 21 and 25 and gap 23 are sized to interconnect with the base plate 13 as described below.

Two side projections 27 and a top projection 28 are formed around the stop plate 11 by bending a section of the stop plate away from the side of the stop plate which confronts the door, the bend forming a straight chord at a minimum distance of about one and a half inches (38 millimeters) from the plate's center. Top projection 28 is perpendicular to side projections 27, which are parallel to each other. The projections 27 and 28 are intended to increase the strength of the stop plate 11 and to allow the stop plate to be hand gripped for mounting and removal from base plate 13. Top projection 28 forms an eyehole 29 located in its center, of sufficient diameter to allow suspension of the plate 11 near the base plate from a hook, string or other means when the lock is not in use.

Base plate 13 is about 3 inches (76 millimeters) in overall width by one and seven-eighths inches (48 millimeters) high. At one end of the base plate 13 are three countersunk screw holes 31 for securing the base plate to the door frame 15.

The opposite end of the base plate 13 is shaped to form an extension 33 about one inch (25 millimeters) high and six-tenths inches (15 millimeters) wide, that connects to the rest of the base plate through a neck 35 that defines a pair of identical notched seats 37 symmetrically arranged about the neck 35 to allow the base plate 13 to operate properly when secured on either side of the door frame 15. The notched seats 37 are sized to be slightly wider than the thickness of the stop plate 11 so that the stop plate will rest within the seat 37 and on the neck 35 when the lock is in use.

Figure 5:
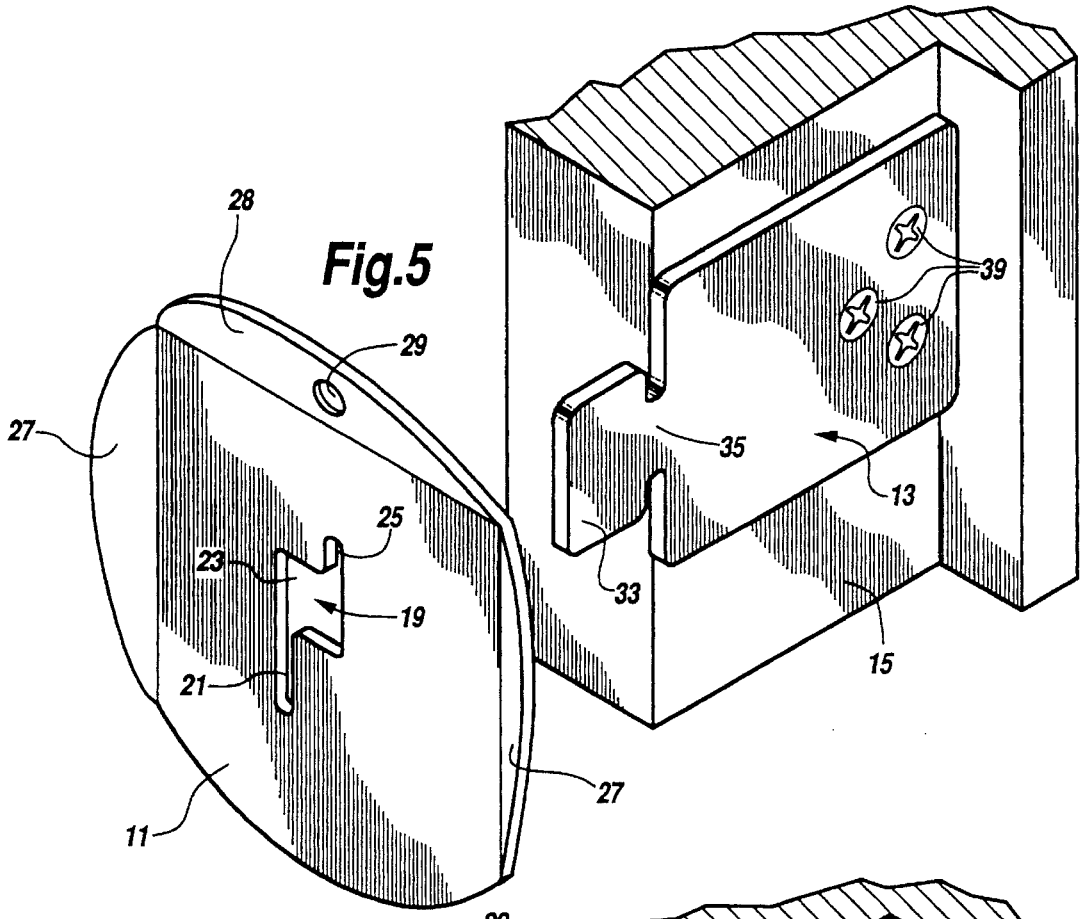
FIG. 5 is a top right perspective exploded view of the preferred embodiment of a keyless lock of the invention illustrating the installation of the base plate on the door frame.
Figure 6:
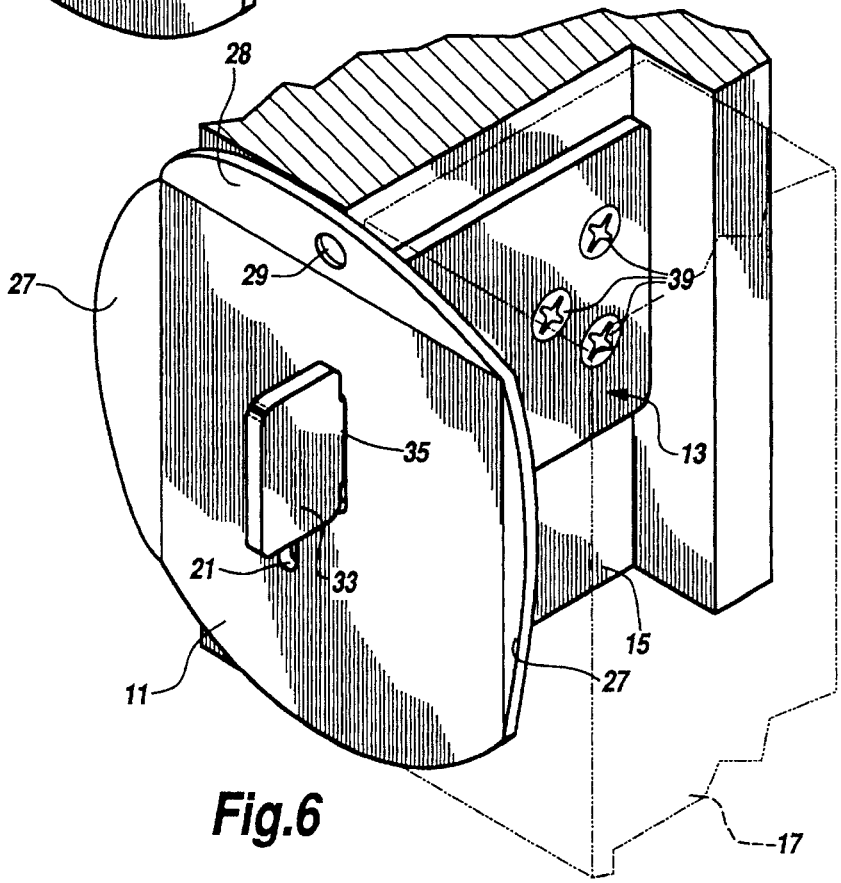
FIG. 6 is a top right perspective view of the preferred embodiment of a keyless lock of the invention with the stop plate in its final position with respect to the base plate, door and door frame.

Turning to FIGS. 5 and 6, we can see the installation and operation of the keyless lock. The base plate 13 is secured to the door frame 15 through the screw holes 31 by three countersink flat-head screws 39 so that extension 33 and notched seat 37 extend beyond the door frame 15 into the space to be secured. To engage the lock, the stop plate 11 is initially brought into proximity with the base plate 13. The long slot 21 is aligned with the base plate 13 as shown in FIG. 5. The stop plate 11 is then mounted on the base plate 13, the base plate extension 33 "passing through" the long slot 21 until the stop plate 11 is vertically aligned with the notched seats 37 and the neck 35. This position is designated the initial position. The stop plate is then lowered into notched seat 37 until the portion of the stop plate defining the upper left corner of gap 23 contacts the base plate neck 35. The stop plate is horizontally displaced until neck 35 lies inside short slot 25. The stop plate is then displaced downward until the portion of stop plate defining the top edge of short slot 25 rests on neck 35 so that a portion of the stop plate lies within notched seat 37 as shown in FIG. 6. This position is designated the final position. While in the final position, the stop plate 11 is prevented from moving along the axis of the base plate 13 by the portions of base plate 13 forming the sides of notched seat 37. If someone attempts to open door 17, stop plate 11 will confront the door, preventing the door from opening into the secured space. To open the lock, the operator need only reverse the steps used to engage the lock.

Several dimensions are critical. The height of long slot 21 should be slightly greater than the height of base plate extension 33 so that the stop plate 11 can be mounted on the base plate 13 bypassing the base plate extension 33 through the long slot 21. Both the height of short slot 25 and the length of both diagonals of gap 23 should be less than the height of the base plate extension 33 to prevent the extension from being passed through either the short slot 23 or the gap 23 of aperture 19, regardless of the angular orientation of the extension 33 with respect to aperture 19.

Figure 7:
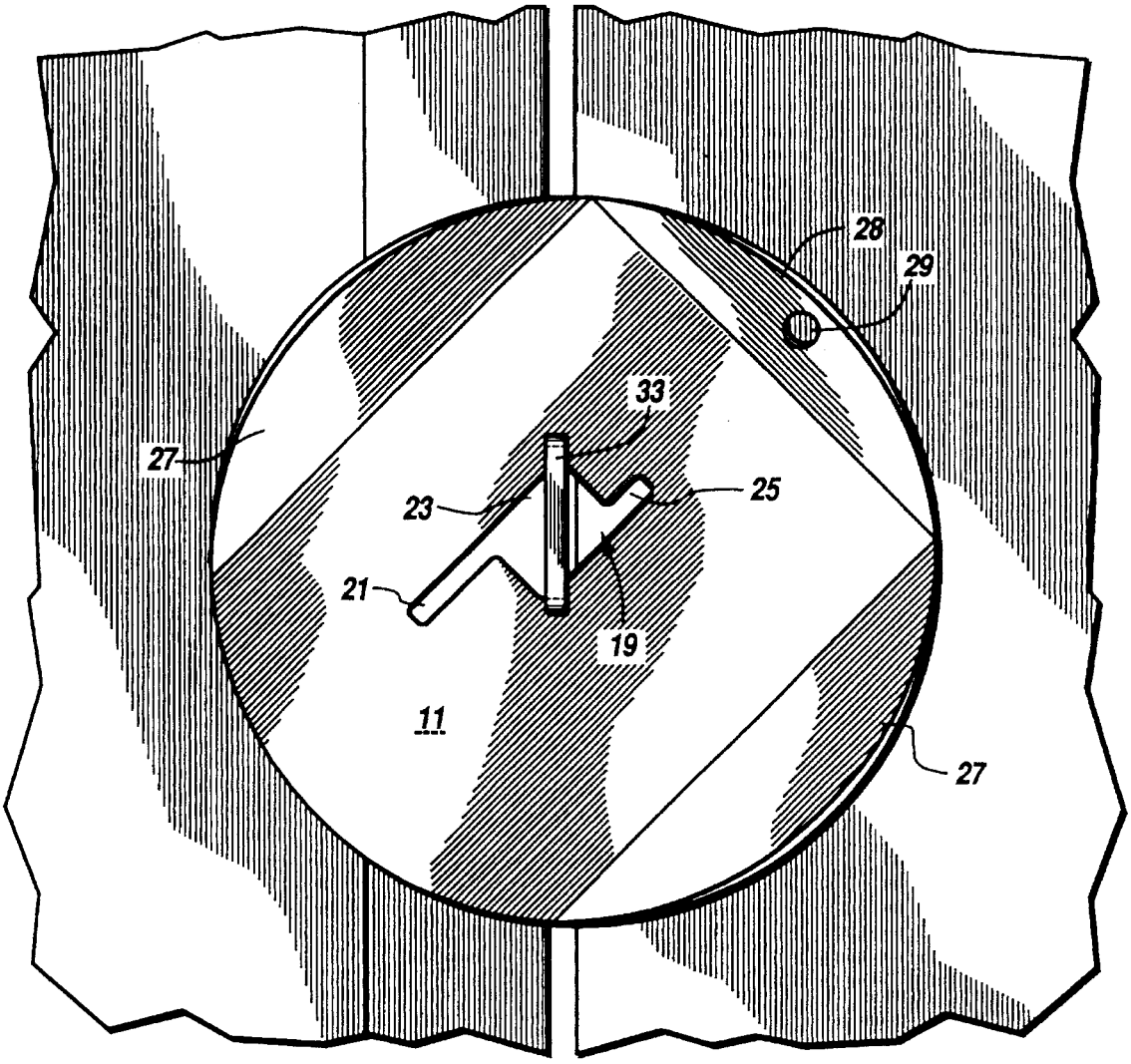
FIG. 7 is a front elevational view of the preferred embodiment of a keyless lock of the invention with the stop plate in a position between the initial position and the final position.

The ability of the stop plate to prevent opening of the door even when not in the final position is illustrated in FIG. 7, where the stop plate 11 is left in a position between the initial position and the final position. This orientation could result if the stop plate is not fully installed, as in the case where the stop plate is simply placed in the initial position and released. The stop plate 11 will pivot under the influence of gravity, eventually coming to rest substantially in the position shown. Although stop plate 11 is not in the final position with respect to base plate 13, it nonetheless positively engages extension 33 and will prevent opening of the door.

Figure 8:
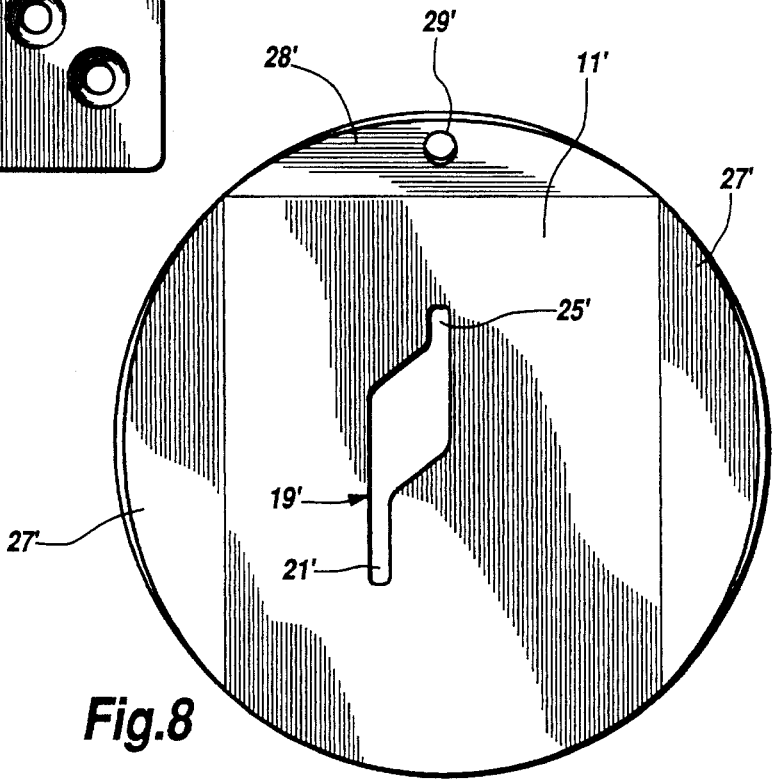
FIG. 8 is a front elevational view of an alternate embodiment of the stop plate.

FIG. 8 shows an alternative embodiment 11' of stop plate 11. The only material difference from the first embodiment is that the gap slants upward from long slot 21' to short slot 25'. This slant has two intended effects. Firstly, since the transition from slot to gap back to slot is less abrupt, it is easier to displace stop plate 11' manually from its initial position to the final position and back. Secondly, the slant allows the weight of the stop plate to provide part of the force required to displace the stop plate from the initial position to the final position, making the locking procedure easier to accomplish.

The keyless lock of the invention has several advantages over the prior art. The keyless lock can be constructed simply and inexpensively. Its operation is simple and intuitive. It is extremely strong and will withstand intense efforts to open the door, yet it will not scratch or otherwise damage the door in operation. The device is designed to operate effectively even if the stop plate is not properly seated in the final position. Finally, the stop plate aperture can be configured so that the weight of the stop plate assists the manual displacement of the stop plate from the initial position to the final position.

The invention has been shown in two alternative embodiments. It should be apparent to those skilled in the art that the invention is not so limited, but is susceptible to various changes and modifications without departing from the spirit of the invention.

We claim:

1. A keyless lock for use on a door with a frame, the door having a vertical edge mounted on the frame with hinges and a latching edge movable between an open position and a closed position, the latching edge and the frame being separated by a gap when the door is in the closed position, said keyless lock comprising:

a base plate to be secured to the frame in the gap between the frame and the latching edge of the door and transverse to the face plane of the door when in the closed position, said base plate having an integral extension that extends to a distal end beyond the door frame into a space to be secured and defining a notched seat thereby; and a planar stop plate adapted to confront the door when in the closed position, said stop plate forming an aperture configured in the form of a substantially rectangular gap defining horizontal and vertical sides and having two substantially parallel slots, one extending downwardly from a lower corner of the gap and one extending upwardly from a diagonally opposite corner of the gap enabling the stop plate to be received over the base plate extension and to rest in the notched seat and interlock transversely to the base plate to prevent opening the door beyond the notched seat.

2. A keyless lock as recited in claim 1, wherein said base plate has a major axis running along the integral extension to the distal end, and said stop plate, while interconnected with the base plate, can be displaced laterally between an initial position, in which the stop plate can be removed from interconnection with the base plate, and a final position, in which the stop plate rests within the notched seat on the base plate and is prevented from movement along the major axis of the base plate by the portions of the base plate which form the sides of the notched seat.

3. A keyless lock as recited in claim 2, wherein the stop plate aperture is shaped so that the stop plate positively engages the base plate extension when the stop plate is in any position between the initial position and the final position.

4. A keyless lock as recited in claim 1, wherein a section of the stop plate is planar and defines an offset angled away from the side of the stop plate facing the door.

5. A keyless lock as recited in claim 1, wherein the stop plate has a projection that allows the stop plate to be hand gripped when seated on the base plate.

6. A keyless lock as recited in claim 5, wherein the stop plate projection is formed by a section of the stop plate offset from the plane of the stop plate away from the side facing the door.

7. A keyless lock as recited in claim 1, further comprising means enabling the stop plate to be suspended near the door frame when not in use.

8. A keyless lock as recited in claim 7, wherein the stop plate forms an eyehole for suspending the stop plate.

9. A keyless lock for use on a door with a frame, the door having a vertical edge mounted on the frame with hinges and a latching edge movable between an open position and a closed position, the latching edge and the frame being separated by a gap when the door is in the closed position, said keyless lock comprising:

a base plate to be secured to the frame in the gap between the frame and the latching edge of the door and transverse to the face plane of the door when in the closed position, said base plate having an integral extension that extends to a distal end beyond the door frame into a space to be secured and defining a notched seat thereby; and a planar stop plate adapted to confront the door when in the closed position, said stop plate forming an aperture configured in the form of two offset parallel slots connected by a gap enabling the stop plate to be received over the base plate extension and to rest in the notched seat and interlock transversely to the base plate to prevent opening the door beyond the notched seat;

wherein said base plate has a major axis running along the integral extension to the distal end, and said stop plate, while interconnected with the base plate, can be displaced laterally between an initial position, in which the stop plate can be removed from interconnection with the base plate, and a final position, in which the stop plate rests within the notched seat on the base plate and is prevented from movement along the major axis of the base plate by the portions of the base plate which form the sides of the notched seat, and wherein the gap in the stop plate aperture is slanted between the slots so that movement of the stop plate from the initial position to the final position is assisted by the gravitational force of the weight of the stop plate.

10. A keyless lock as recited in claim 9, wherein a section of the stop plate is planar and defines an offset angled away from the side of the stop plate facing the door.

11. A keyless lock as recited in claim 9, wherein the stop plate has a projection that allows the stop plate to be hand gripped when seated on the base plate.

12. A keyless lock as recited in claim 11, wherein the stop plate projection is formed by a section of the stop plate offset from the plane of the stop plate away from the side facing the door.

13. A keyless lock as recited in claim 9, further comprising means enabling the stop plate to be suspended near the door frame when not in use.

14. A keyless lock as recited in claim 13, wherein the stop plate forms an eyehole for suspending the stop plate.

* * * * *